US009328901B2

(12) United States Patent
Kwon et al.

(10) Patent No.: US 9,328,901 B2
(45) Date of Patent: May 3, 2016

(54) LED LAMP

(71) Applicant: Younghwan Jang, Seoul (KR)

(72) Inventors: Mi Suk Kwon, Seoul (KR); Su Hyeon Kwon, Seoul (KR)

(73) Assignee: Younghwan Jang, Seoul (KR)

( * ) Notice: Subject to any disclaimer, the term of this patent is extended or adjusted under 35 U.S.C. 154(b) by 29 days.

(21) Appl. No.: 14/363,291

(22) PCT Filed: Oct. 26, 2012

(86) PCT No.: PCT/KR2012/008873

§ 371 (c)(1),
(2) Date: Jun. 5, 2014

(87) PCT Pub. No.: WO2013/077561

PCT Pub. Date: May 30, 2013

(65) Prior Publication Data

US 2014/0334162 A1 Nov. 13, 2014

(30) Foreign Application Priority Data

Nov. 23, 2011 (KR) ..... 10-2011-0122998

(51) Int. Cl.

| | |
|---|---|
| ***F21V 15/01*** | (2006.01) |
| ***F21V 33/00*** | (2006.01) |
| ***F21V 19/00*** | (2006.01) |
| ***F21K 99/00*** | (2016.01) |
| ***F21S 8/10*** | (2006.01) |
| *F21Y 101/02* | (2006.01) |

(52) U.S. Cl.

CPC . *F21V 15/01* (2013.01); *F21K 9/30* (2013.01); *F21S 48/212* (2013.01); *F21S 48/215* (2013.01); *F21S 48/2206* (2013.01); *F21S 48/328* (2013.01); *F21V 19/004* (2013.01); *F21V 19/0035* (2013.01); *F21V 33/0052* (2013.01); *F21Y 2101/02* (2013.01)

(58) Field of Classification Search

CPC ... F21V 15/01; F21V 19/004; F21V 33/0052; F21V 19/0035; F21S 48/215; F21S 48/328; F21S 48/212

See application file for complete search history.

(56) References Cited

U.S. PATENT DOCUMENTS

| | | | | |
|---|---|---|---|---|
| 6,152,568 | A | 11/2000 | Baba et al. | |
| 2005/0162864 | A1 * | 7/2005 | Verdes et al. | 362/555 |

FOREIGN PATENT DOCUMENTS

| | | | |
|---|---|---|---|
| JP | 11-284309 | A | 10/1999 |
| KR | 10-2008-0042993 | A | 5/2008 |
| KR | 10-2011-0030753 | A | 3/2011 |

* cited by examiner

*Primary Examiner* — Anne Hines

(74) *Attorney, Agent, or Firm* — IM IP Law PLLC; C. Andrew Im

(57) ABSTRACT

A light emitting diode (LED) lamp comprises a casing part inserted into the region on which the lamp is installed. A PCB part is seated on the casing part in two stage. A connector part connects and fixes the PCB part to the casing part to supply power to the PCB part. A cover part is disposed above the PCB part to protect the LED mounted on the PCB part. The casing part comprises a cover fixing part and a coupling protrusion is disposed on the cover part. The coupling protrusion is inserted and fixed into the cover fixing part. An adhesive is applied to the bottom surface of the coupling protrusion to insert the coupling protrusion into the cover fixing part, thereby firmly coupling the coupling protrusion to the cover fixing part.

17 Claims, 6 Drawing Sheets

LED LAMP

RELATED APPLICATIONS

This application is a §371 application from PCT/KR2012/008873 filed Oct. 26, 2012, which claims priority from Korean Patent Application No. 10-2011-0122998 filed Nov. 23, 2011, each of which is herein incorporated by reference in its entirety.

TECHNICAL FIELD

The present invention relates to an LED lamp, and more particularly, to an LED lamp which includes a casing part having a cover fixing part, a cover part having a coupling protrusion inserted and fixed into the cover fixing part, and an adhesive applied to the bottom surface of the coupling protrusion such that the cover part is more firmly coupled to the casing part when the coupling protrusion is inserted into the cover fixing part.

BACKGROUND ART

In general, LED lamps are used for back lightings which are mounted inside dashboards or switches, or used for lightings which are mounted inside or outside a vehicle like incandescent lamps and fluorescent lamps in order to help a user to distinguish things, such as courtesy lights of vehicles, license plate lamps for distinguishing license plates at night, trunk lamps, wing mirror lamps, fender lamps, winker lamps, and so on. Now, such conventional LED lamps will be described.

First, the conventional LED lamps use filament lamps of various shapes, but has several disadvantages in that they lamps have very short lifespan (about 100 hours to 1,000 hours), generate lots of heat so that a user may get scalded when grasping it with hands, consume lots of power (5 Watt to 30 Watt), and are darker than LED lights.

Second, the conventional LED lamps use high-intensity LEDs on a metal PCB, but have several disadvantages in that they are more expensive than other existing products because a metal PCB is applied only to resistance and LEDs which generate lots of heat and a general PCB is applied to the remaining circuit parts due to a high price of the metal PCB and in that the entire set of the LED lamp must be changed at the time of after service because they need separate controllers.

Therefore, in order to solve the above-mentioned problems, the LED lamp was manufactured into a socket type using the general PCB. However, due to a lack of thermal control technology, even though the quantity of light which corresponds to 40 percent of characteristics of the mounted LED is just used, namely, a rated current of the LED is 350 mA but only 150 mA is used, the LED lamp also needs radiation of heat using a reflector due to generation of high heat.

CITED REFERENCE

Cited Reference 1) Korean Patent No. 10-0830417

OBJECT AND SUMMARY OF THE INVENTION

TECHNICAL PROBLEM

Accordingly, the present invention has been made in an effort to solve the above-mentioned problems occurring in the prior arts, and it is an object of the present invention to provide an LED lamp which includes a casing part and a cover part mounted above the casing part so as to spread light emitted from LEDs mounted on a PCB part.

It is another object of the present invention to provide an LED lamp which can reduce material expenses because the casing part uses the existing injection-molded case as it is and which includes a plurality of through holes formed on the bottom surface of the casing part so as to increase a heat radiation effect.

It is a further object of the present invention to provide an LED lamp in which the PCBs having nonpolar circuits are mounted in two stages so that lots of components can be mounted in a narrow space, which can easily discharge a great deal of heat emitted from the LED mounted on the PCB because the two PCBs are spaced apart from each other at a predetermined interval, and which provides convenience in use of the LED by using the nonpolar circuit.

TECHNICAL SOLUTION

To achieve the above objects, the present invention provides an LED lamp including: a casing part inserted into the region on which the lamp will be installed; a PCB part seated on the casing part in two stages; a connector part adapted for connecting and fixing the PCB part to the casing part to supply electric power to the PCB part; a cover part disposed above the PCB part to protect an LED mounted on the PCB part, wherein the casing part includes a cover fixing part and the cover part includes a coupling protrusion, such that the cover part is fixed to the casing part.

The casing part includes: a PCB insertion part disposed at the central portion of the upper face for seating the PCB part thereon; and a base part extending downwardly from the PCB insertion part and having a plurality of vent holes formed in the bottom surface thereof.

The PCB insertion part includes: recesses located on the upper face of the casing part and formed in such a way as to expose the connector part inserted into the base part to the outside; a PCB seating part formed internally in such a way that the PCB part is seated thereon; and a cover fixing part located on the PCB seating part in order to fix the cover part.

The PCB part includes a plurality of PCBs which are different in size, are formed in a circular shape and are mounted in multiple stages, and a first PCB and a second PCB respectively includes a plurality of cover fixing part joining grooves formed in the side surfaces thereof in such a way as to be joined with the cover fixing part.

The cover part is seated above the casing part, and includes: a plurality of cavities formed at the lower portion thereof for exposing the connector fixing hole of the PCB part to the outside; the coupling protrusion which is coupled with the cover fixing part of the casing part; a retaining jaw joined with the outer circumferential surface of the first PCB; a light collecting part which is formed on the upper portion of the inner face of the cover part for collecting light emitted from the LED.

The light collecting part is formed to collect light emitted from the LED mounted above the PCB part and has a concave upper surface so as to widely spread the emitted light.

A pair of retaining protrusions are formed on the outer face of the casing part, and polarity(+,−) of the casing part is indicated in such a way that the retaining protrusions have different sizes or the connector part have different sizes or different colors from each other so as to indicate the polarity (+,−) of the casing part.

Figure 1:
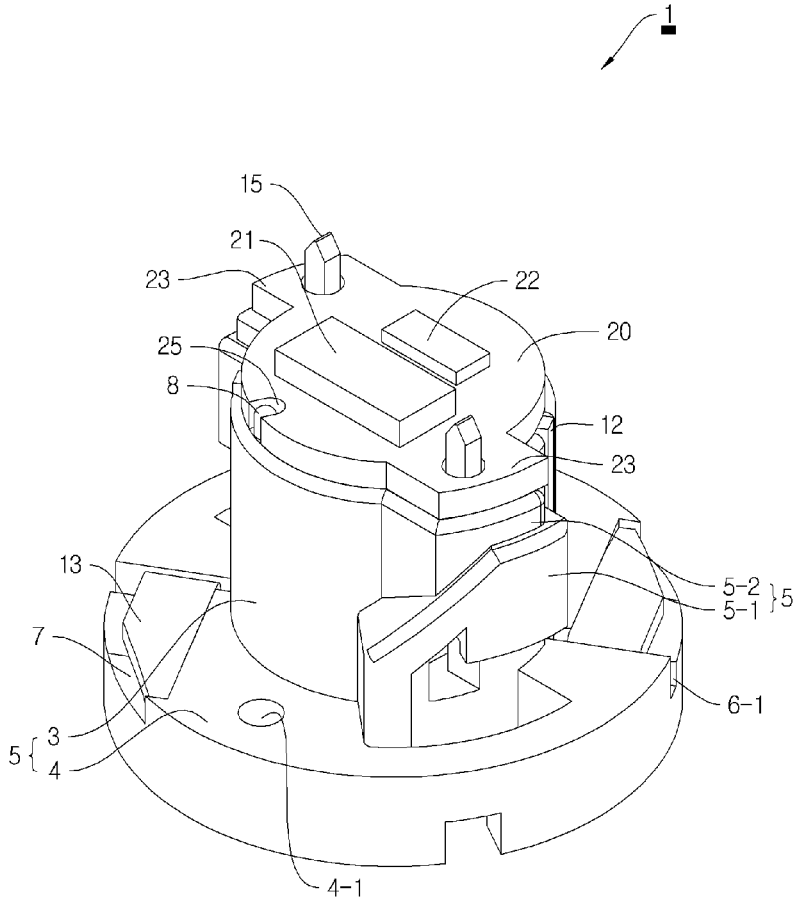
FIG. 1 is a perspective view of a conventional LED lamp.

| Explanation of essential reference numerals in drawings: | |
|---|---|
| 10: casing part | 20: PCB part |
| 30: connector part | 40: cover part |

DETAILED DESCRIPTION OF THE EMBODIMENTS

Reference will be now made in detail to the preferred embodiment of the present invention with reference to the attached drawings. In the drawings, the same components have the same reference numerals even though they are illustrated in different figures. In addition, in the description of the present invention, when it is judged that detailed descriptions of known functions or structures related with the present invention may make the essential points vague, the detailed descriptions of the known functions or structures will be omitted.

Figure 2:
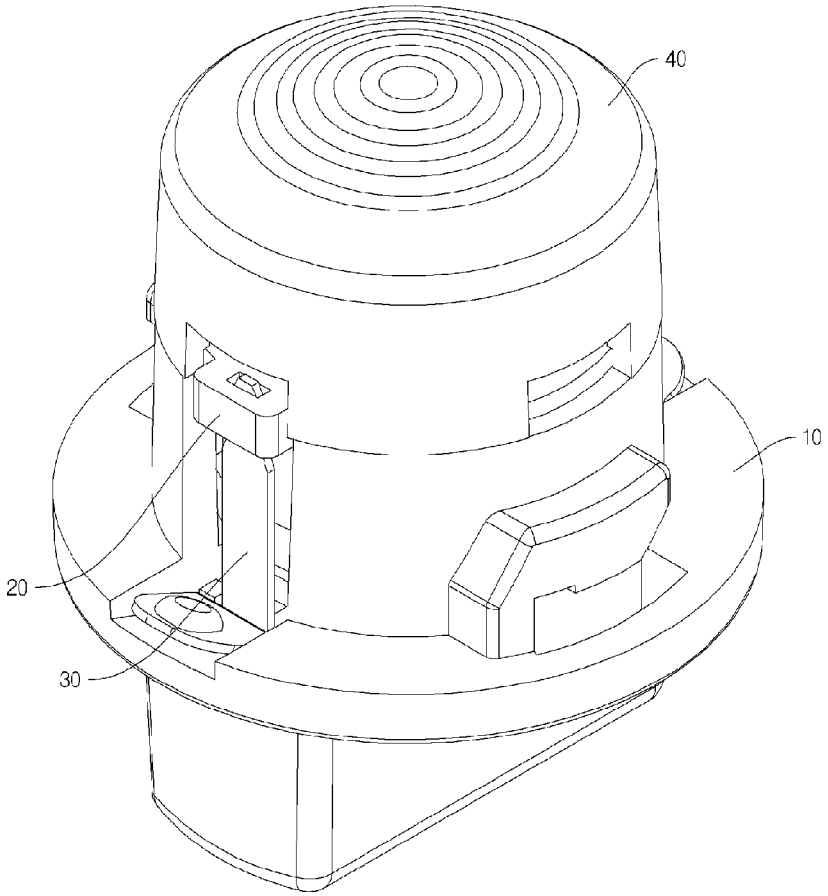
FIG. 2 is a perspective view of an LED lamp according to a first preferred embodiment of the present invention.
Figure 3:
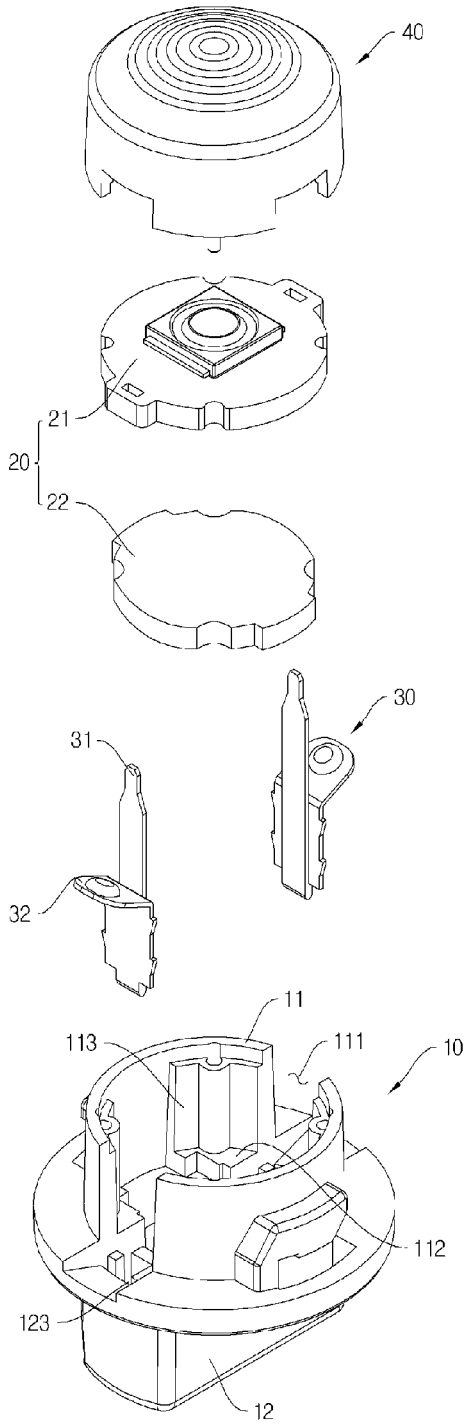
FIG. 3 is an exploded perspective view of the LED lamp according to the first preferred embodiment of the present invention.
Figure 4:
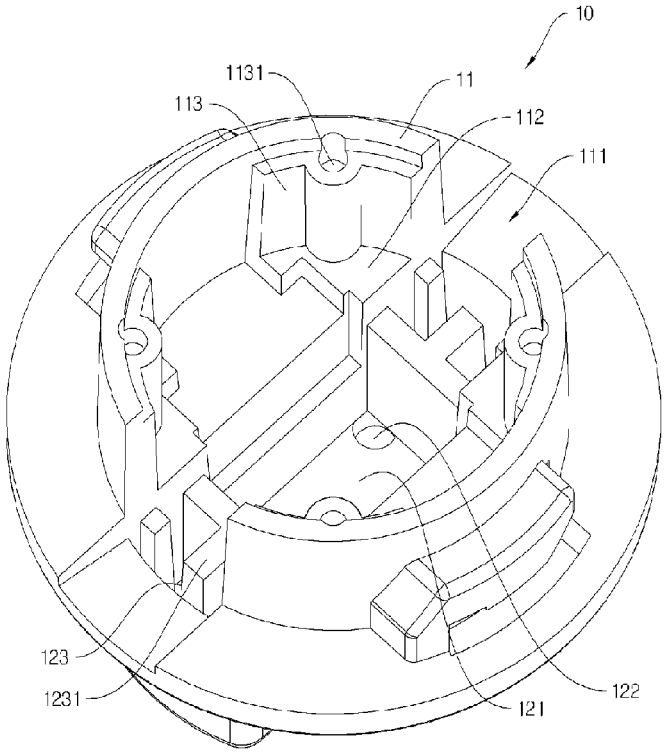
FIG. 4 is a perspective view of a casing part of the LED lamp according to the first preferred embodiment of the present invention.
Figure 5:
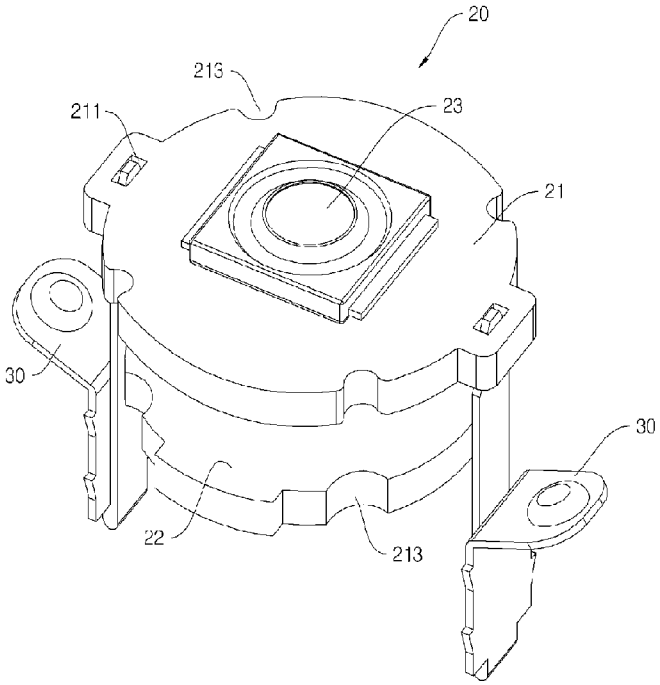
FIG. 5 is a perspective view of a PCB of the LED lamp according to the first preferred embodiment of the present invention.
Figure 6:
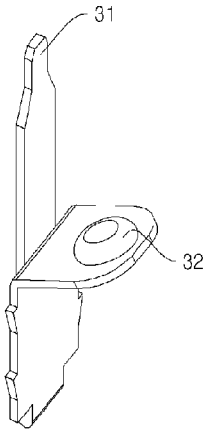
FIG. 6 is a perspective view of a connector part of the LED lamp according to the first preferred embodiment of the present invention.
Figure 7:
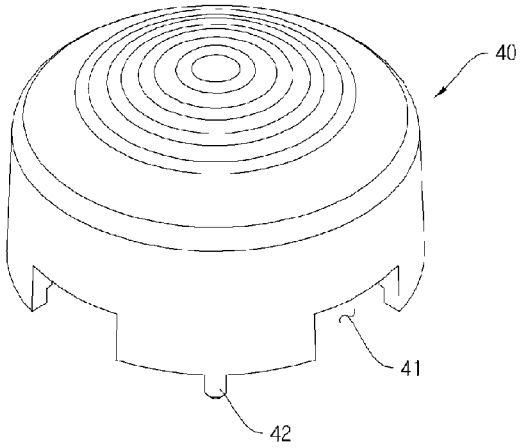
FIG. 7 is a perspective view of a cover part of the LED lamp according to the first preferred embodiment of the present invention.
Figure 8:
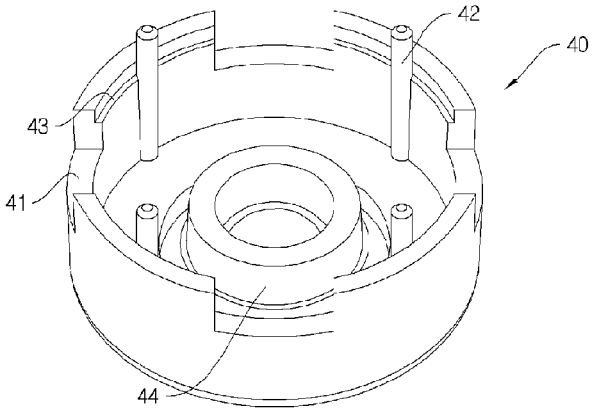
FIG. 8 is a rear side view of the cover part of the LED lamp according to the first preferred embodiment of the present invention.
Figure 9:
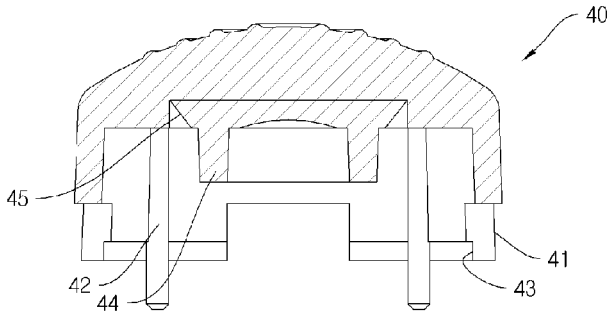
FIG. 9 is a sectional view of the cover part of the LED lamp according to the first preferred embodiment of the present invention.

FIG. 2 is a perspective view of an LED lamp according to a first preferred embodiment of the present invention, FIG. 3 is an exploded perspective view of the LED lamp according to the first preferred embodiment of the present invention, FIG. 4 is a perspective view of a casing part of the LED lamp according to the first preferred embodiment of the present invention, FIG. 5 is a perspective view of a PCB of the LED lamp according to the first preferred embodiment of the present invention, FIG. 6 is a perspective view of a connector part of the LED lamp according to the first preferred embodiment of the present invention, FIG. 7 is a perspective view of a cover part of the LED lamp according to the first preferred embodiment of the present invention, FIG. 8 is a rear side view of the cover part of the LED lamp according to the first preferred embodiment of the present invention, and FIG. 9 is a sectional view of the cover part of the LED lamp according to the first preferred embodiment of the present invention.

Referring to FIGS. 2 to 9, the LED lamp which is mounted inside or outside a vehicle in order to help user to distinguish things includes: a casing part 10 inserted into the region on which the lamp is installed; a PCB part 20 seated on the casing part 10 in two stages; a connector part 30 adapted for connecting and fixing the PCB part 20 to the casing part 10 to supply power to the PCB part 20; and a cover part 40 disposed above the PCB part 20 to protect the LED mounted on the PCB part 20.

As shown in FIGS. 2 to 4, the casing part 10 includes: a PCB insertion part 11 disposed at the central portion of the upper face for seating the PCB part 20 thereon; and a base part 12 extending downwardly from the PCB insertion part 11 and having a plurality of vent holes 122 formed in the bottom surface thereof.

The casing part 10 further includes a retaining protrusion 13 formed on the outer face thereof to firmly couple the casing part 10 with an outer case of the lamp.

The PCB insertion part 11 includes: recesses 111 located on the upper face of the casing part 10 and formed in such a way as to expose the connector part 30 inserted into the base part 12 to the outside; a PCB seating part 112 formed internally in such a way that the PCB part 20 is seated thereon; and a cover fixing part 113 located on the PCB seating part 112 in order to fix the cover part 40.

The recesses 111 are spaced apart from one another at regular intervals in such a manner that the connector part 30 inserted into one side of the base part 12 is exposed to the outside so as to apply power flowing from the outside to the PCB part 20 fixed to the connector part 30.

The PCB seating part 112 is formed between the PCB insertion part 11 and the base part 12, and the undermost PCB out of PCBs which are inserted in multiple stages may be seated on the PCB seating part 112.

The cover fixing part 113 is located on the PCB seating part 112 and has an insertion through hole 1131 formed therein. The insertion through hole 1131 has a predetermined depth in such a manner that the coupling protrusion 42 of the cover part 40 is inserted thereinto so as to fix the cover part 40 to the casing part 10.

The base part 12 is formed below the PCB insertion part 11 and has a predetermined depth, and includes: a heat circulation passage 121 for circulating heat emitted from the PCB part 20; a plurality of vent holes 122 communicatably connected with the heat circulation passage 121 and formed in the bottom surface of the base part 12 to discharge the heat to the outside; and a connector insertion part 123 formed on the side of the base part 12 in such a way that the connector part 30 is inserted thereinto.

The connector insertion part 123 is formed to insert the connector part 30 thereinto and includes a T-shaped partition 1231 formed between the connector insertion part 123 and the heat circulation passage 121 to press the inserted connector part 30 so as to prevent the connector part 30 from being easily separated from the base part 12.

A pair of the retaining protrusions 13 are formed on the outer face of the casing part 10 and opposed to each other. Polarity (+,−) of the casing part 10 can be indicated in such a way that a pair of the retaining protrusions 13 have different sizes from each other.

As shown in FIG. 5, the PCB part 20 includes a first PCB 21 and a second PCB 22 which are different in size and are formed in a circular shape, and can increase a heat radiation effect when the first and second PCBs 21 and 22 are spaced apart from each other at a predetermined interval. Moreover, differently from the conventional product that many components are mounted on one PCB and that requires a wide space, the PCB part 20 according to the present invention can be used conveniently even at a small space because the components are divided and mounted on the two PCBs, namely, on the first PCB 21 and the second PCB 22.

An LED 23 is mounted on the first PCB 21, and can be connected without regard to polarity (+,−) due to a nonpolar circuit formed on the PCB part 20.

Furthermore, the first PCB 21 which is located at an upper portion is larger than the second PCB 22, and includes a connector fixing hole 211 formed at one side thereof for fixing the connector part 40. Therefore, electric power flown from the connector part 40 can flow to the first PCB 21 and the second PCB 22.

Additionally, a plurality of cover fixing part joining grooves 213 and 223 are formed in the side surface of the first and second PCBs 21 and 22 in such a way as to be joined with the cover fixing part 113.

The connector part 30 serves to fix the PCB part 20 to the casing part 10 and to supply power to the PCB part 20, and is inserted and fixed into the connector insertion part 123 formed in the casing part 10.

As shown in FIG. 6, the connector part 30 includes: a protrusion 31 formed on the upper face thereof in such a way as to be inserted into the connector fixing hole 211 of the first PCB 21; and a power inflow part 32 protruding from the side of the connector part 30 toward an end portion or the outside so as to apply electric power introduced from the outside.

Furthermore, the connector parts 30 are inserted into both sides of the casing part 10, and polarity (+,−) of the casing part 10 can be indicated in such a way that the connector part 30 have different sizes or different colors from each other.

The cover part 40 is seated above the casing part 10, and as shown in FIGS. 7 to 9, and includes: a plurality of cavities 41 formed at the lower portion thereof for exposing the connector fixing hole 211 of the PCB part 20 to the outside; the coupling protrusion which is coupled with the cover fixing part 113 of the casing part 10; a retaining jaw 43 joined with the outer circumferential surface of the first PCB 21; a light collecting part 44 which is formed on the upper portion of the inner face of the cover part 40 and has a concave upper surface so as to collect light emitted from the LED 23 mounted on the upper surface of the first PCB 21 and to widely spread the emitted light; and an inclined surface 45 formed at an end portion of the light collecting part 44 so as to facilitate the light widely spread by the light collecting part 44.

Additionally, when the coupling protrusion 42 is coupled with the cover fixing part 113 of the casing part 10, the bottom surface of the coupling protrusion 42 is coated with an adhesive or treated with ultrasonic waves, and then, the coupling protrusion 42 is inserted into the cover fixing part 113 so as to be coupled with the cover fixing part 113 more firmly.

Figure 10:
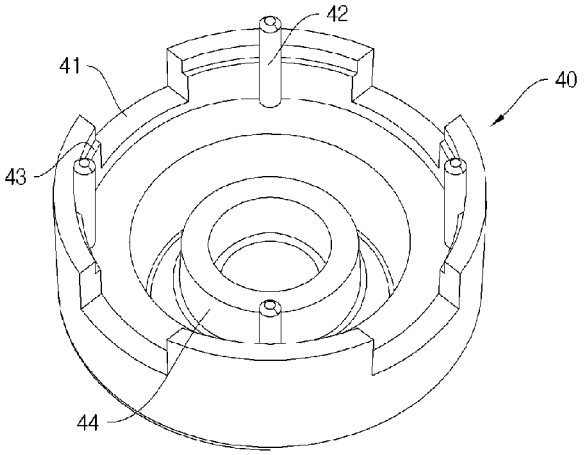
FIG. 10 is a rear side view of a cover part of an LED lamp according to a second preferred embodiment of the present invention.
Figure 11:
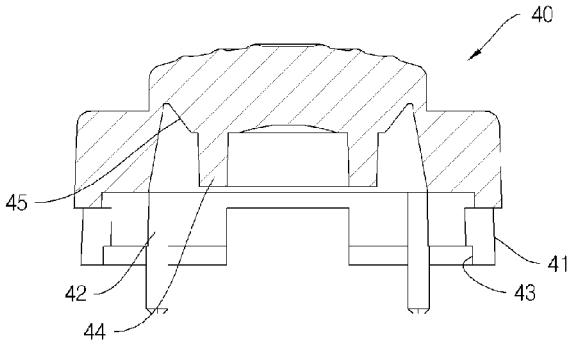
FIG. 11 is a sectional view of the cover part of the LED lamp according to the second preferred embodiment of the present invention.

In the meantime, in order to avoid interference with the outer case to which an LED assembly is inserted, as shown in FIGS. 10 and 11, the upper height of the cover part 40 may get higher As described above, while the present invention has been particularly shown and described with reference to the example embodiments thereof, it will be understood by those of ordinary skill in the art that the above embodiments of the present invention are all exemplified and various changes, modifications and equivalents may be made therein without changing the essential characteristics and scope of the present invention. Therefore, it would be understood that the embodiments disclosed in the present invention are not to limit the technical idea of the present invention but to describe the present invention, and the technical and protective scope of the present invention shall be defined by the illustrated embodiments. It should be also understood that the protective scope of the present invention is interpreted by the following claims and all technical ideas within the equivalent scope belong to the technical scope of the present invention.

INDUSTRIAL APPLICABILITY

Through the above-mentioned structure, the LED lamp according to the preferred embodiments of the present invention can get the following effects.

The present invention relates to a lamp which is installed inside or outside of a vehicle in order to help a user to distinguish things like courtesy lights of vehicles, license plate lamps for distinguishing license plates at night, trunk lamps, wing mirror lamps, fender lamps, winker lamps, and so on. When the coupling protrusion of the cover part is coupled with the cover fixing part of the casing part, the bottom surface of the coupling protrusion is coated with an adhesive or treated with ultrasonic waves, and then, the coupling protrusion is inserted into the cover fixing part so as to be coupled with the cover fixing part more firmly. After that, necessary components are mounted on the PCB in such a manner that the nonpolar circuit is formed on the PCB so that the LED can be mounted on the PCB without regard to its polarity, and in this instance, the components are dividedly mounted on the upper PCB and the lower PCB, such that lots of the components can be mounted even on the narrow space. Because the PCBs are spaced apart from each other at the predetermined interval, it provides the heat radiation effect. Because a plurality of the through holes are formed in the bottom surface of the casing part, the heat generated from the PCB part is circulated so as to increase the heating effect.

Moreover, the PCBs formed in two stages can be simply inserted and fixed into the casing part using the connector part, thus being used to the cases of the conventional lamps, reducing expenses, and providing a simple assembly of the components because its structure is simple.

The invention claimed is:

1. A light emitting diode (LED) lamp comprising:

a casing part inserted into a region on which the lamp will be installed;

a PCB part comprising two sections seated on the casing part in two stages;

a connector part for connecting and fixing the PCB part to the casing part to supply electric power to the PCB part;

a cover part disposed above the PCB part to protect an LED mounted on the PCB part;

wherein the cover part comprises a coupling protrusion, such that the cover part is fixed to the casing part;

wherein the casing part comprises: a cover fixing part; a PCB insertion part disposed at a central portion of an upper face of the casing part for seating the PCB part thereon; and a base part extending downwardly from the PCB insertion part and having a plurality of vent holes formed in a bottom surface thereof; and wherein the PCB insertion part comprises: recesses located on the upper face of the casing part and formed to expose the connector part inserted into the base part to outside; a PCB seating part formed internally such that the PCB part is seated thereon; and a cover fixing part located on the PCB seating part to fix the cover part.

2. The LED lamp according to claim 1, wherein the PCB part comprises a plurality of PCBs which are different in size, are formed in a circular shape and are mounted in multiple stages; and wherein a first PCB and a second PCB, each respectively comprises a plurality of cover fixing part joining grooves formed in side surfaces thereof and configured to join with the cover fixing part.

3. The LED lamp according to claim 2, wherein the cover part is seated above the casing part, and comprises: a plurality of cavities formed at a lower portion thereof for exposing a connector fixing hole of the PCB part to outside; the coupling protrusion which is coupled with the cover fixing part of the casing part; a retaining jaw joined with an outer circumferential surface of the first PCB; and a light collecting part which is formed on an upper portion of an inner face of the cover part for collecting light emitted from the LED.

4. The LED lamp according to claim 3, wherein the light collecting part is formed to collect light emitted from the LED mounted above the PCB part and has a concave upper surface to spread the emitted light.

5. The LED lamp according to claim 1, wherein a pair of retaining protrusions are formed on an outer face of the casing part, and a polarity (+,−) of the casing part is indicated such that the retaining protrusions have different sizes or the connector part have different sizes or different colors from each other to indicate the polarity (+,−) of the casing part.

6. The LED lamp according to claim 1, wherein the PCB part comprises a plurality of PCBs which are different in size, are formed in a circular shape and are mounted in multiple stages; wherein the cover part is seated above the casing part, and comprises: a plurality of cavities formed at a lower portion thereof for exposing a connector fixing hole of the PCB part to outside; the coupling protrusion which is coupled with the cover fixing part of the casing part; a retaining jaw joined with an outer circumferential surface of a first PCB; and a light collecting part which is formed on an upper portion of an inner face of the cover part for collecting light emitted from the LED.

7. A light emitting diode (LED) lamp comprising:

a casing part inserted into a region on which the lamp will be installed;

a PCB part comprising two sections seated on the casing part in two stages;

a connector part for connecting and fixing the PCB part to the casing part to supply electric power to the PCB part;

a cover part disposed above the PCB part to protect an LED mounted on the PCB part;

wherein the casing part comprises a cover fixing part and the cover part comprises a coupling protrusion, such that the cover part is fixed to the casing part; and wherein the PCB part comprises a plurality of PCBs which are different in size, are formed in a circular shape and are mounted in multiple stages; and wherein a first PCB and a second PCB, each respectively comprises a plurality of cover fixing part joining grooves formed in side surfaces thereof and configured to join with the cover fixing part.

8. The LED lamp according to claim 7, wherein the casing part comprises: a PCB insertion part disposed at a central portion of an upper face of the casing part for seating the PCB part thereon; and a base part extending downwardly from the PCB insertion part and having a plurality of vent holes formed in a bottom surface thereof; and wherein the PCB insertion part comprises: recesses located on the upper face of the casing part and formed to expose the connector part inserted into the base part to outside; a PCB seating part formed internally such that the PCB part is seated thereon; and a cover fixing part located on the PCB seating part to fix the cover part.

9. The LED lamp according to claim 8, wherein the cover part is seated above the casing part, and comprises: a plurality of cavities formed at a lower portion thereof for exposing a connector fixing hole of the PCB part to outside; the coupling protrusion which is coupled with the cover fixing part of the casing part; a retaining jaw joined with an outer circumferential surface of the first PCB; and a light collecting part which is formed on an upper portion of an inner face of the cover part for collecting light emitted from the LED.

10. The LED lamp according to claim 9, wherein the light collecting part is formed to collect light emitted from the LED mounted above the PCB part and has a concave upper surface to spread the emitted light.

11. The LED lamp according to claim 7, wherein a pair of retaining protrusions are formed on an outer face of the casing part, and a polarity (+,−) of the casing part is indicated such that the retaining protrusions have different sizes or the connector part have different sizes or different colors from each other to indicate the polarity (+,−) of the casing part.

12. A light emitting diode (LED) lamp comprising:

a casing part inserted into a region on which the lamp will be installed;

a PCB part comprising two sections seated on the casing part in two stages;

a connector part for connecting and fixing the PCB part to the casing part to supply electric power to the PCB part;

a cover part disposed above the PCB part to protect an LED mounted on the PCB part;

wherein the casing part comprises a cover fixing part and the cover part comprises a coupling protrusion, such that the cover part is fixed to the casing part; and wherein a pair of retaining protrusions are formed on an outer face of the casing part, and a polarity (+,−) of the casing part is indicated such that the retaining protrusions have different sizes or the connector part have different sizes or different colors from each other to indicate the polarity (+,−) of the casing part.

13. The LED lamp according to claim 12, wherein the casing part comprises: a PCB insertion part disposed at a central portion of an upper face of the casing part for seating the PCB part thereon; and a base part extending downwardly from the PCB insertion part and having a plurality of vent holes formed in a bottom surface thereof; and wherein the PCB insertion part comprises: recesses located on the upper face of the casing part and formed to expose the connector part inserted into the base part to outside; a PCB seating part formed internally such that the PCB part is seated thereon; and a cover fixing part located on the PCB seating part to fix the cover part.

14. The LED lamp according to claim 12, wherein the PCB part comprises a plurality of PCBs which are different in size, are formed in a circular shape and are mounted in multiple stages; and wherein a first PCB and a second PCB, each respectively comprises a plurality of cover fixing part joining grooves formed in side surfaces thereof and configured to join with the cover fixing part.

15. The LED lamp according to claim 14, wherein the cover part is seated above the casing part, and comprises: a plurality of cavities formed at a lower portion thereof for exposing a connector fixing hole of the PCB part to outside; the coupling protrusion which is coupled with the cover fixing part of the casing part; a retaining jaw joined with an outer circumferential surface of the first PCB; and a light collecting part which is formed on an upper portion of an inner face of the cover part for collecting light emitted from the LED.

16. The LED lamp according to claim 15, wherein the light collecting part is formed to collect light emitted from the LED mounted above the PCB part and has a concave upper surface to spread the emitted light.

17. The LED lamp according to claim 12, wherein the PCB part comprises a plurality of PCBs which are different in size, are formed in a circular shape and are mounted in multiple stages; wherein the cover part is seated above the casing part, and comprises: a plurality of cavities formed at a lower portion thereof for exposing a connector fixing hole of the PCB part to outside; the coupling protrusion which is coupled with the cover fixing part of the casing part; a retaining jaw joined with an outer circumferential surface of a first PCB; and a light collecting part which is formed on an upper portion of an inner face of the cover part for collecting light emitted from the LED.

* * * * *